US007311574B2

(12) United States Patent
Roos

(10) Patent No.: US 7,311,574 B2
(45) Date of Patent: Dec. 25, 2007

(54) INTEGRATED MARINE MOTOR SUPPORT AND TRANSMISSION APPARATUS

(75) Inventor: Paul W. Roos, Delray Beach, FL (US)

(73) Assignee: Apex Hydro Jet, LLC, Delray Beach, FL (US)

( * ) Notice: Subject to any disclaimer, the term of this patent is extended or adjusted under 35 U.S.C. 154(b) by 0 days.

(21) Appl. No.: 10/947,955

(22) Filed: Sep. 23, 2004

(65) Prior Publication Data

US 2006/0009097 A1 Jan. 12, 2006

Related U.S. Application Data

(60) Provisional application No. 60/505,066, filed on Sep. 23, 2003.

(51) Int. Cl.
*B63H 20/14* (2006.01)
*B63H 11/00* (2006.01)

(52) U.S. Cl. ..... 440/111; 440/38; 440/75

(58) Field of Classification Search ..... 440/111, 440/75, 38

See application file for complete search history.

(56) References Cited

U.S. PATENT DOCUMENTS 2,769,420 A * 11/1956 Horton et al. ..... 440/75
4,854,903 A * 8/1989 Sirois ..... 440/83
5,421,753 A 6/1995 Roos
5,520,558 A * 5/1996 Kobayashi ..... 440/38
6,193,569 B1 2/2001 Davies et al.

FOREIGN PATENT DOCUMENTS

JP 05330485 A * 12/1993
WO WO 9408845 A1 * 4/1994

* cited by examiner

*Primary Examiner*—Jesús D Sotelo
(74) *Attorney, Agent, or Firm*—Jansson Shupe & Munger Ltd.

(57) ABSTRACT

An integrated motor support and transmission apparatus for a marine propulsion system having a motor and marine drive with a drive shaft, comprising: an output shaft; a support housing attached to a marine vessel and having an upper end and a lower end, the upper end supporting the motor and the lower end substantially aligning the output shaft with the marine drive; and a transmission connecting the motor to the output shaft, whereby the motor, transmission, and output shaft can be installed in the marine vessel in a single operation.

8 Claims, 6 Drawing Sheets

PRIOR ART

INTEGRATED MARINE MOTOR SUPPORT AND TRANSMISSION APPARATUS

RELATED APPLICATION

This application is based on U.S. Provisional Application No. 60/505,066 filed on Sep. 23, 2003, the contents of which are incorporated herein by reference.

FIELD OF THE INVENTION

This invention relates to marine vehicles, and more particularly to apparatus for interfacing motors, transmissions, and output shaft couplings into marine propulsion systems.

BACKGROUND OF THE INVENTION

Marine drives such as propeller drives, surface drives, and waterjets each have many benefits for propulsion of marine vessels. However, a disadvantage inherent to all of these drives is the large amount of space taken up by the motor and the transmission, both of which are typically placed in front of the marine drive. The motor provides the power to drive the marine drive via a transmission that adapts the rotational speed of the motor to that of the marine drive. Especially in the case of an electrical motor or a gas turbine, the difference between input and output rotational speeds is quite significant and requires several speed reduction steps.

If the motor is placed over the top of a marine drive such as a waterjet (or beside or at an angle, half over, or half beside), a great deal of space in the vessel in front of the marine drive can be advantageously used for cargo or passengers, making the vessel more useful. In addition, the longitudinal center-of-gravity will be advantageously shifted aft, in general producing better vessel performance. The motor is no longer placed in the bilge, avoiding the effects of corrosion due to exposure to bilge water. If the motor is an internal combustion engine, the motor exhaust line is located relatively higher and is better protected from exhaust duct backwash.

In order to locate the motor further aft, it is possible to support the motor over the marine drive and to locate the transmission in front of the drive in the vessel with the motor output shaft protruding forward. However, this will require a special transmission and two sets of drive lines and a great deal of added weight, vessel structure and alignment labor. FIG. 1 portrays such a prior art installation, illustrating a waterjet 8 as the marine drive. It requires vessel internal support structures for motor 6, for motor mounts 1, for transmission 7 with its own mounts 2, and for forward drive carrier bearing 3. Flexible couplings 4 and drive shafts 5 are necessary to transmit power from motor 6 to waterjet 8. This is costly for a waterjet-propelled vessel builder or retrofitter to accomplish, placing him at a disadvantage in the marketplace. In addition, the installation is neither space-efficient nor lightweight.

OBJECTS OF THE INVENTION

It is an object of this invention to provide apparatus enabling installation of the motor, transmission, and output shaft in a marine vessel reliably and accurately in a single operation.

Another object of the invention is to provide a compact marine propulsion system.

Another object of the invention is to provide a simple mounting arrangement for a marine propulsion system.

Another object of the invention is to provide for factory assembly and pretesting of the motor, transmission, and output shaft of a marine propulsion system prior to installation in a marine vessel.

Another object of the invention is to provide a lighter weight marine propulsion system.

Another object of the invention is to provide apparatus which is able to interface a variety of motors, transmissions, and output shafts to a variety of marine drives.

Still another object of the invention is to locate the motor of a marine propulsion system away from the bilge of the marine vessel and further aft for better vessel performance.

Yet another object of the invention is to locate the motor of a marine propulsion system higher in the vessel such that the exhaust system is not exposed to backwash.

These and other objects of the invention will be apparent from the following descriptions and from the drawings.

SUMMARY OF THE INVENTION

The invention is an integrated motor support and transmission apparatus for a marine propulsion system having a motor and marine drive with a drive shaft, comprising: an output shaft; a support housing attached to a marine vessel and having an upper end and a lower end, the upper end supporting the motor and the lower end substantially aligning the output shaft with the marine drive; and a transmission connecting the motor to the output shaft, thereby enabling the motor, transmission, and output shaft to be installed in the marine vessel in a single operation.

In a highly preferred embodiment of the invention, the integrated motor support and transmission apparatus further includes two main support brackets to support the weight of the apparatus and a plurality of flexible motor mounts for removably attaching the apparatus to the vessel. The integrated motor support and transmission apparatus also includes an output shaft coupling connecting the output shaft to the drive shaft of the marine drive.

In another embodiment of the invention, the integrated motor support and transmission apparatus further includes an output shaft bearing mounted in the integrated motor support and transmission apparatus to support the output shaft rotatably and to transmit thrust from the drive shaft of the marine drive to the integrated motor support and transmission apparatus.

In some preferred embodiments of the inventive apparatus, the upper end of the integrated motor support and transmission apparatus is offset from a position directly above the lower end.

In another preferred embodiment of the invention, the integrated motor support and transmission apparatus also includes: an input shaft connected to the output of the motor; a reversing system; and a clutch. The reversing system and the clutch uncouple and reverse the rotation of the output shaft in relation to the input shaft. The reversing system and clutch may be connected to the input shaft or to the output shaft.

In still another preferred embodiment of the invention, the integrated motor support and transmission apparatus further includes a mounting surface positioned perpendicular to one of the input and output shafts, the mounting surface providing for the installation of motor-connected auxiliary components.

As used herein, the term "marine drive" refers to the apparatus which couples the power from the motor of a marine propulsion system to the water such as a propeller, a surface-piercing propeller, a waterjet, or a ducted propeller.

DETAILED DESCRIPTION OF PREFERRED EMBODIMENTS

The inventive integrated motor support and transmission apparatus avoids the use of a conventional marine transmission and flexible drive lines, thereby saving weight, expense and space inside the marine vessel as well as reducing the need to separately support the motor, transmission, and a bearing supporting the drive shaft of the marine drive. One set of motor mounts supports all components.

Figure 1:
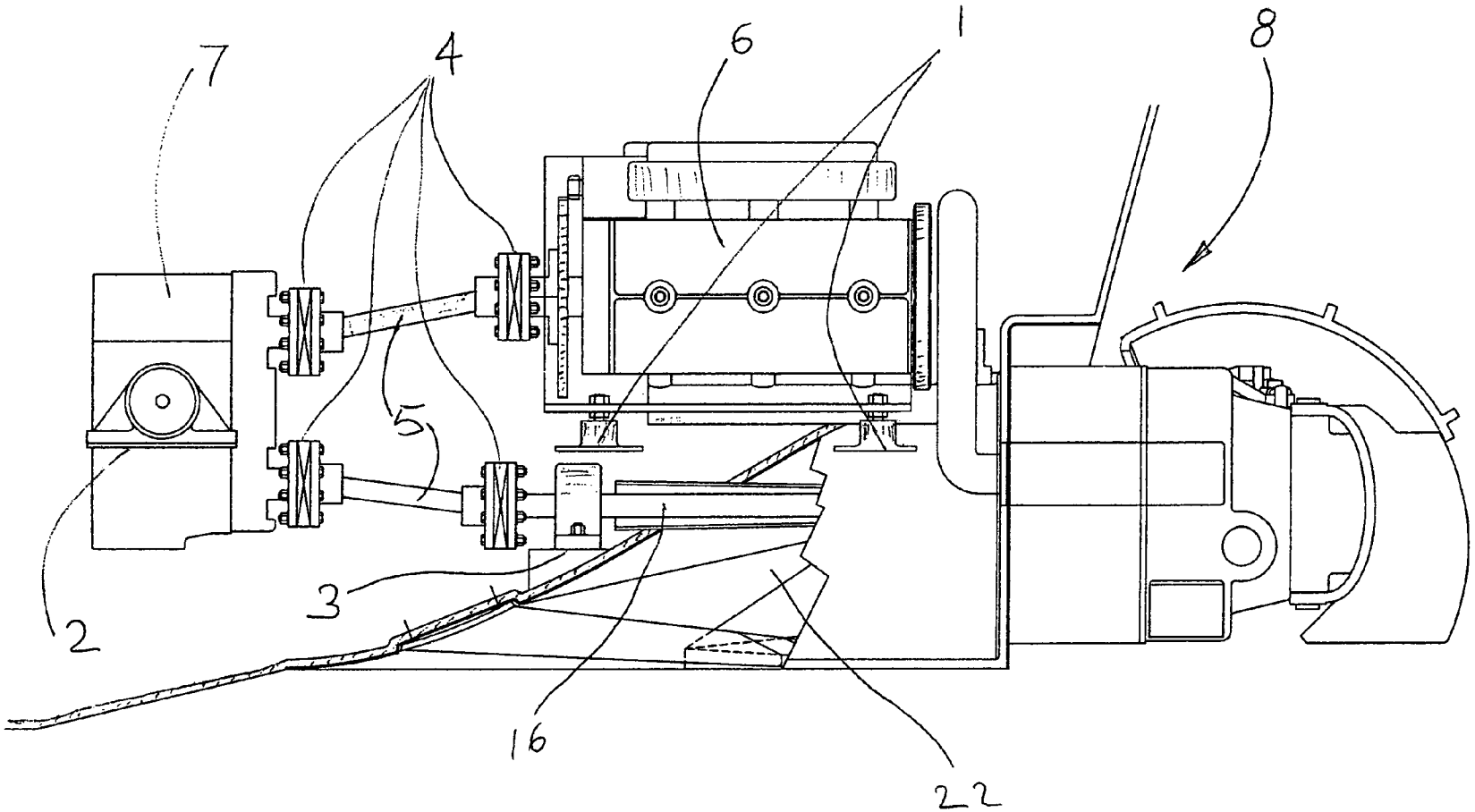
FIG. 1 is a partial section elevation of a prior art drive installation illustrating the need for the present invention.

The advantages of the inventive apparatus can be easily recognized by comparing the prior art of FIG. 1 with the invention shown in FIGS. 2 through 6.

Figure 2:
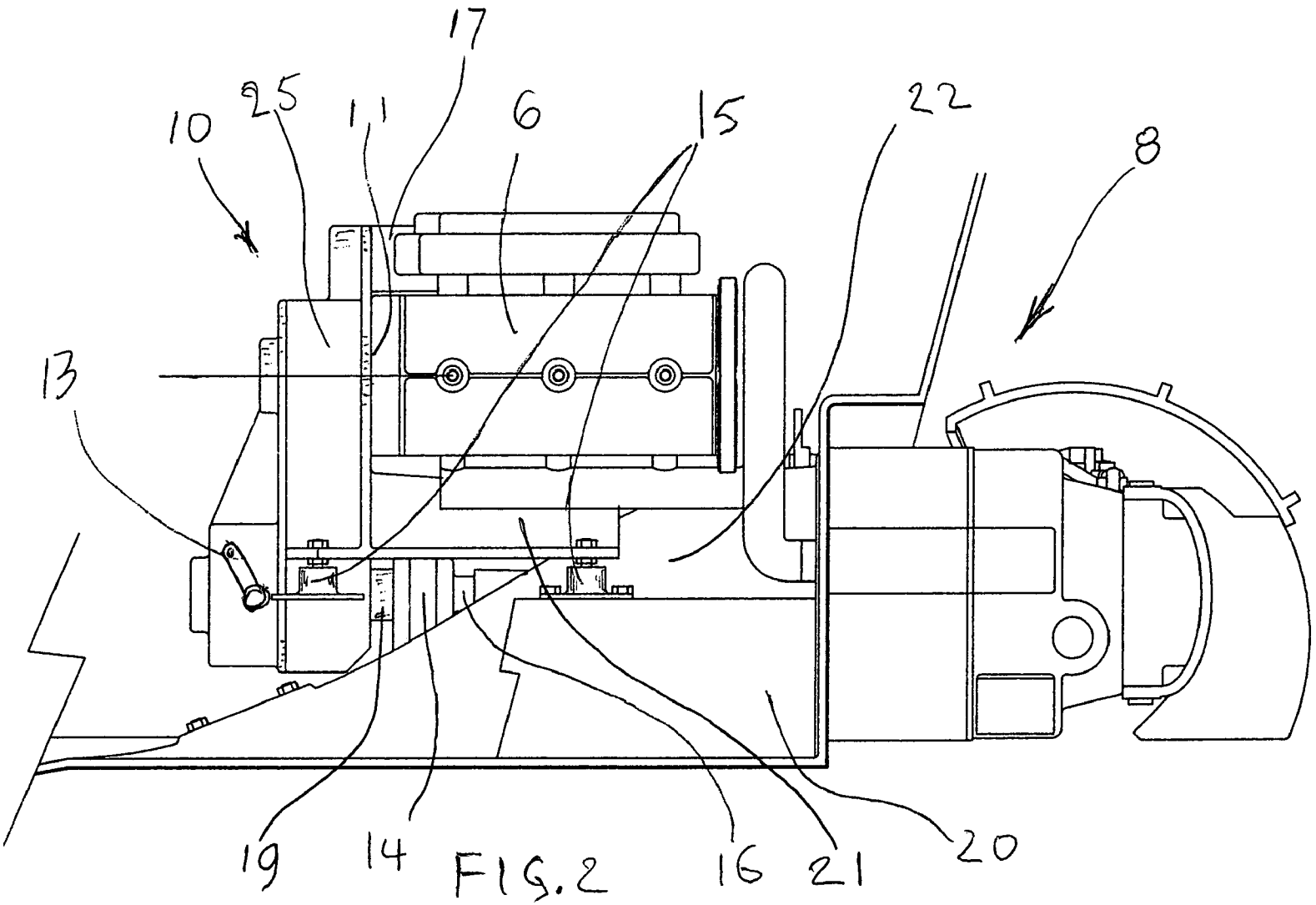
FIG. 2 is an elevation view of a waterjet installation using the inventive integrated motor support and transmission apparatus.

Referring to FIG. 2, an integrated motor support and transmission apparatus 10 (hereinafter known as apparatus 10) includes a motor interface surface 11 at an upper end 28 of apparatus 10, to which is mounted motor 6, and a support housing 25 encasing a transmission 12 (see FIGS. 3 and 4). Also included in apparatus 10 are a set of mounting brackets 21 (one shown) and a set of flexible motor mounts 15 mounted on a set of vessel stringers 20. A shift lever 13 actuates a reversing system 31. A motor starter 17 is also mounted to motor interface surface 11. A coupling 14 connects an output shaft 19, at a lower end 29 of apparatus 10, to a drive shaft 16 of a waterjet marine drive 8.

Figure 3:
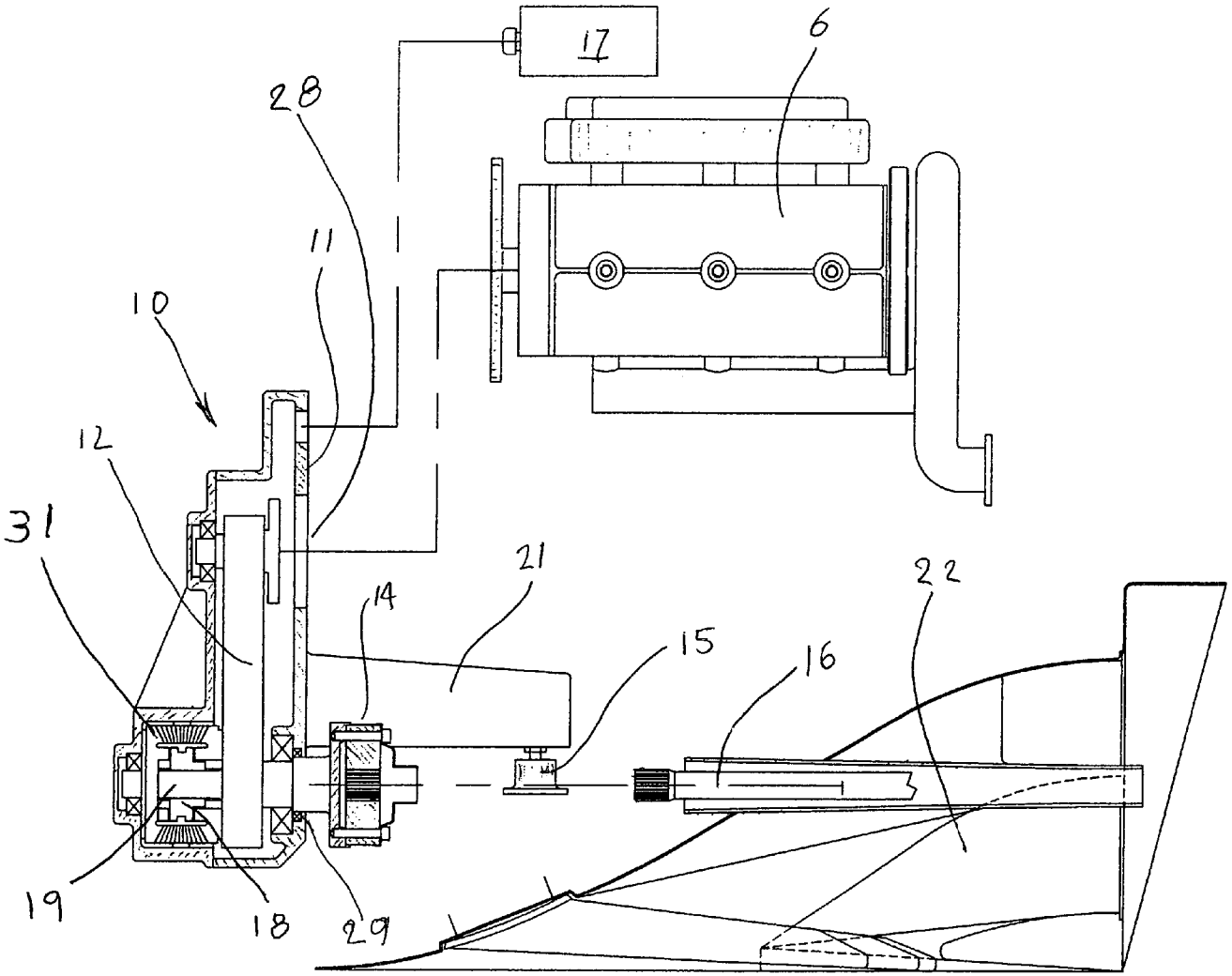
FIG. 3 is an elevation partial section and exploded view of the inventive integrated motor support and transmission apparatus, also showing the motor and the drive shaft of the marine drive.

FIG. 3 shows an exploded view of apparatus 10, illustrating both the internal components of apparatus 10 and the connective relationships of the external components of apparatus 10.

Figure 4:
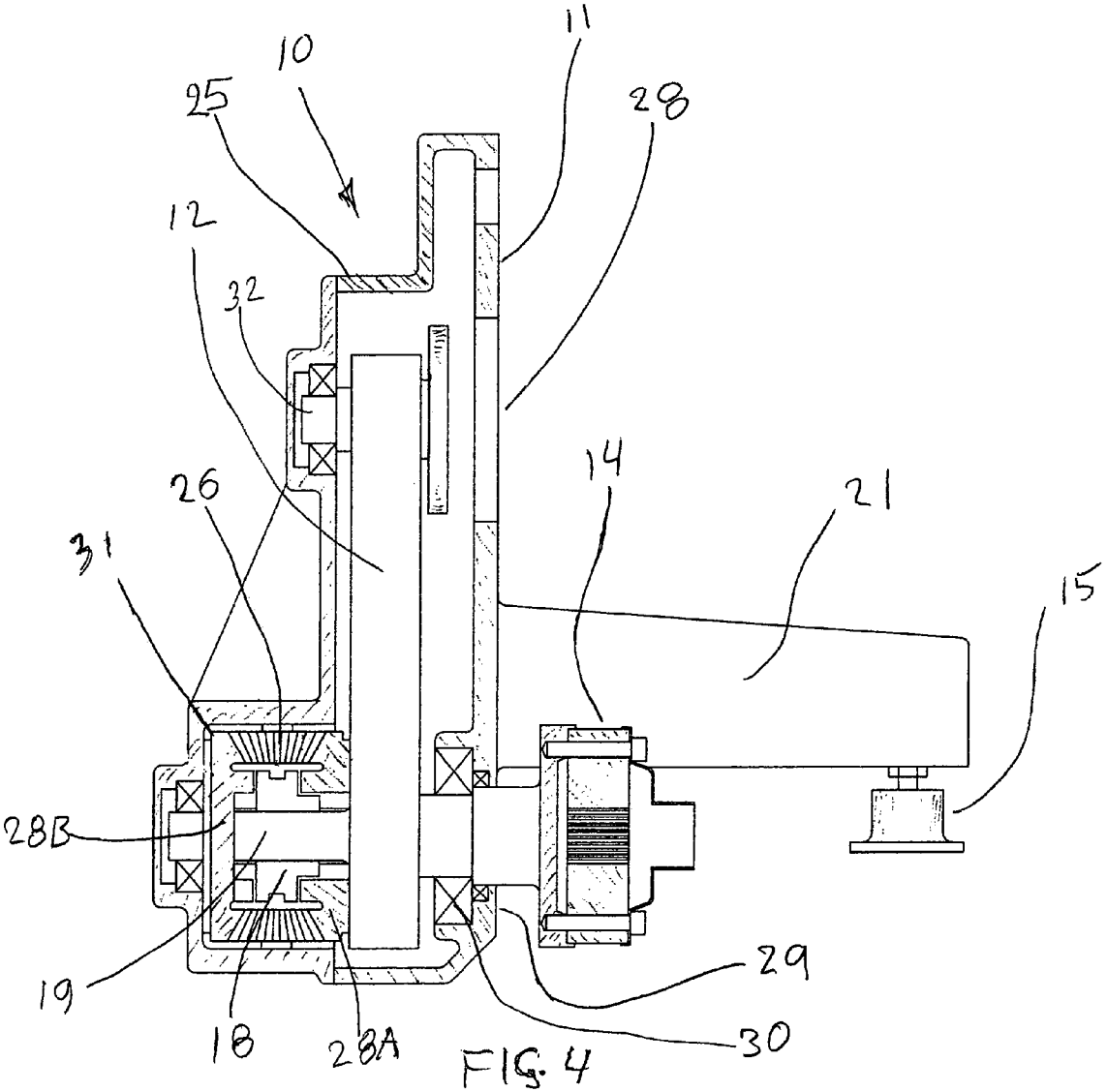
FIG. 4 is a larger section view of the inventive integrated motor support and transmission apparatus.

Referring to FIG. 4, an enlarged view of apparatus 10 from FIG. 3, apparatus 10 further includes reversing system 31 and a clutch 18. Reversing system 31 includes two idler bevel pinion gears 26 which engage two bevel gears 28A and 28B. Gear 28A drives either output shaft 19 directly through clutch 18 or, when clutch 18 engages gear 28B, output shaft 19 in the reverse direction through gear 28B.

In the neutral position of clutch 18, when neither gears 28A or 28B are engaged by clutch 18, output shaft 19 is decoupled from motor 6 to allow motor 6 to run without driving waterjet 8. The "reverse" position of transmission 12 is provided for the removal of debris from the intake 22 of waterjet 8. Transmission 12 is shown as a chain gear transmission but may also be mesh gears, a chain drive, cycloidal drive, or any suitable combination of power transmission components which provide the necessary reduction ratio and power-transmitting capability between motor 6 and waterjet 8. Clutch 18 may be a dog, friction, disc, or band clutch, mechanically, hydraulically or electrically actuated. Reversing system 31 may include straight gears or other various gears. Such components and configurations are well-known to those skilled in the art of mechanical transmissions.

In FIG. 4, a bearing 30 is located on output shaft 19 to support shaft 19 in apparatus 10 and to transmit thrust forces from drive shaft 16.

Referring again to FIG. 3, motor interface surface 11 is made so as to align motor 6 permanently to apparatus 10 with the use of fasteners and registers.

Figure 5:
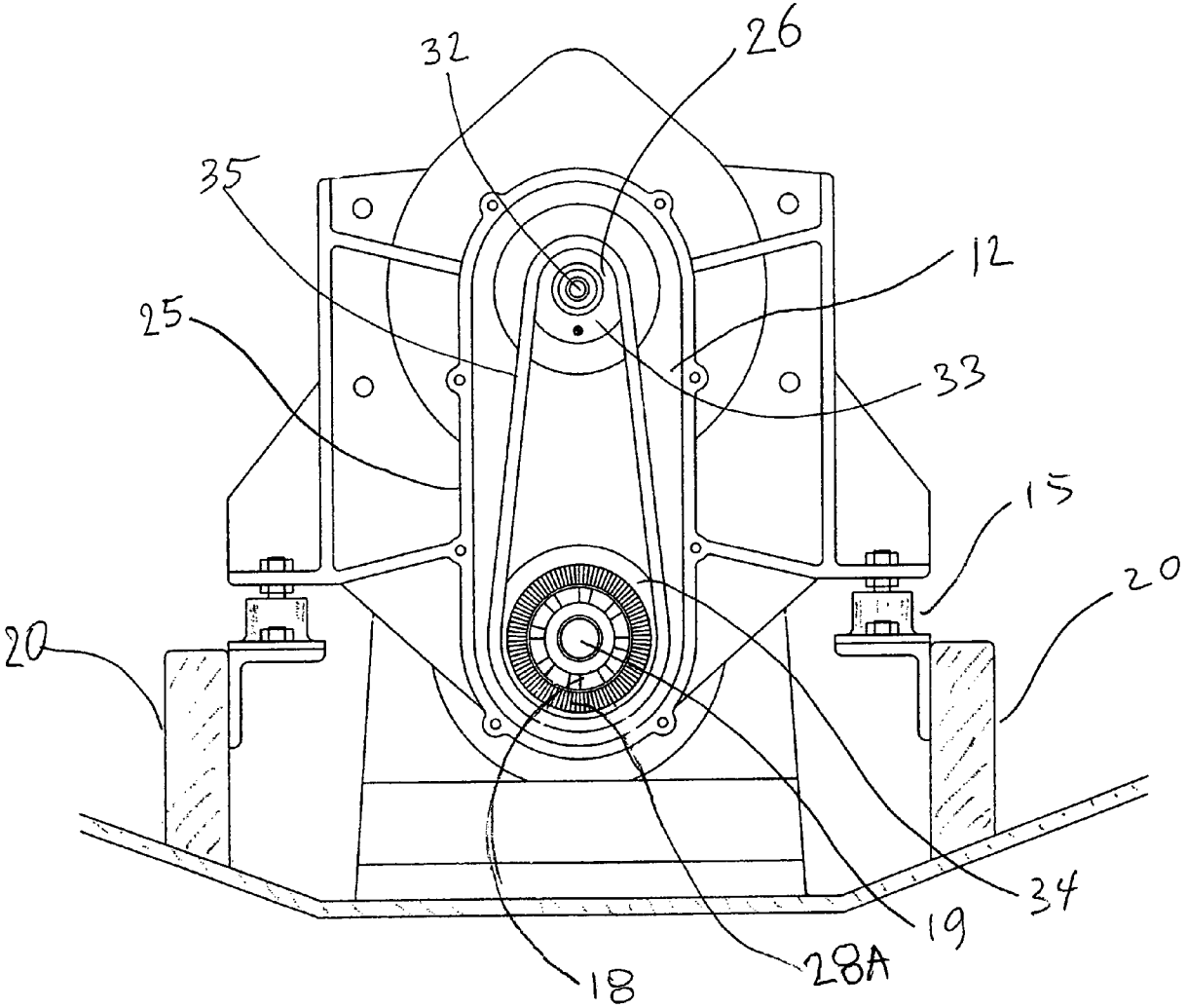
FIG. 5 is an end view of the inventive integrated motor support and transmission apparatus with its housing cover removed.

Referring to FIG. 5, apparatus 10 has at least three flexible motor mounts 15 to anchor it to stringers 20 of the vessel (not shown) or a center mount (not shown) over waterjet intake duct 22. Vessel stringers 20 run longitudinally in the vessel alongside intake duct 22. Flexible motor mounts 15 isolate the vibration of apparatus 10 from stringers 20 and the boat hull (not shown), resulting in the attenuation of noise and vibration in the vessel. In FIG. 3, output shaft 19 is located at lower end 29 of apparatus 10 and has a flexible coupling 14 that connects to drive shaft 16 to allow apparatus 10 to vibrate on motor mounts 15 without alignment interference with drive shaft 16.

Transmission 12 is shown in more detail in FIG. 5. Transmission 12 includes an upper shaft 32, an upper sprocket 33, lower sprocket 34 on output shaft 19, and a chain belt 35 drivably connecting upper sprocket 33 and lower sprocket 34. Bevel gear 28A and clutch 18 can also be seen in FIG. 5.

Figure 6:
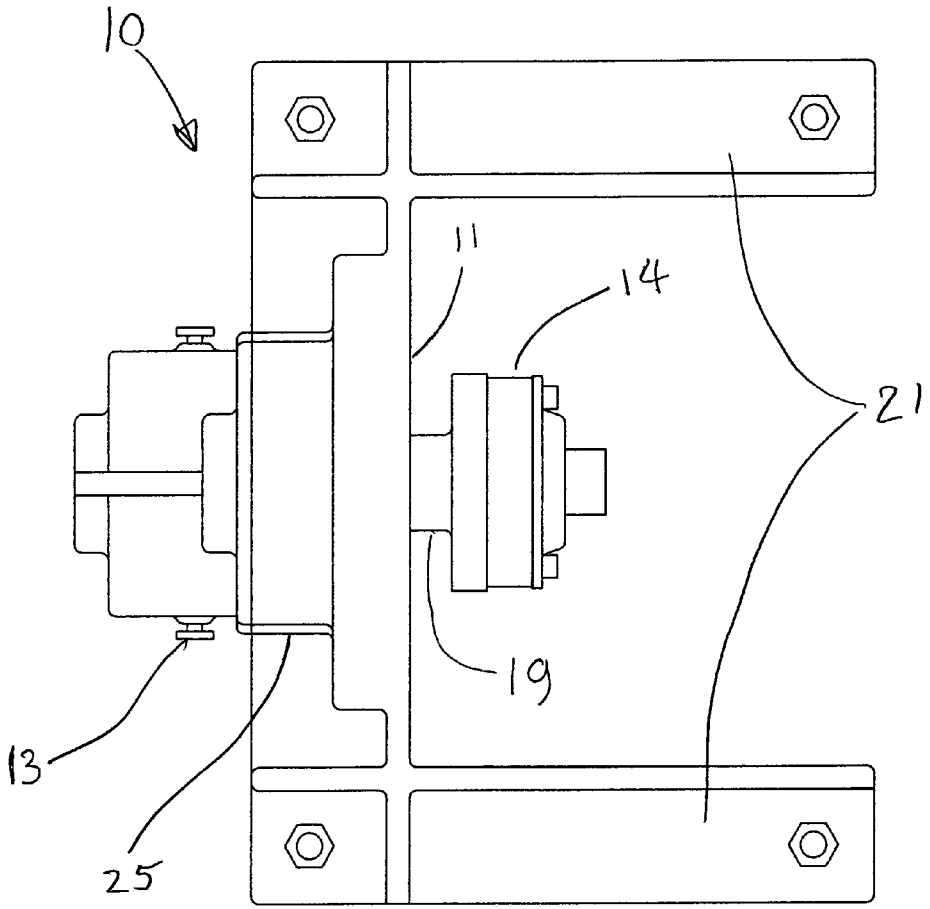
FIG. 6 is a plan view of the inventive integrated motor support and transmission apparatus.

FIG. 6 shows a plan view of apparatus 10 primarily illustrating the positions of brackets 21 relative the primary components of apparatus 10.

While the principles of this invention have been described in connection with specific embodiments, it should be understood clearly that these descriptions are made only by way of example and are not intended to limit the scope of the invention.

The invention claimed is:

1. In marine vessel waterjet propulsion apparatus including (a) a motor with a motor shaft, (b) a waterjet with a drive shaft, and (c) a transmission having an output shaft coupled to the drive shaft, the transmission operatively connecting the motor shaft to the output shaft, the improvement comprising:

a single support structure that (a) fully supports the motor, (b) incorporates and fully supports the transmission, and (c) is removably mounted directly to the vessel by flexible mounts; and a flexible coupling connecting the output shaft to the drive shaft, thereby providing vibrational isolation of the motor-transmission/output shaft combination from the vessel and waterjet while preserving fixed alignment of motor and transmission/output shaft and allowing installation and removal of the motor and the transmission/output shaft in a single operation.

2. The marine vessel waterjet propulsion apparatus of claim 1 wherein the transmission includes:

an input shaft connected to the motor shaft;

a reversing system; and a clutch, whereby the reversing system and the clutch uncouple and reverse the rotation of the output shaft in relation to the input shaft.

3. The marine vessel waterjet propulsion apparatus of claim 2 wherein the reversing system and clutch are connected to the input shaft.

4. The marine vessel waterjet propulsion apparatus of claim 2 wherein the reversing system and clutch are connected to the output shaft.

5. The marine vessel waterjet propulsion apparatus of claim 1 further including a mounting surface oriented substantially perpendicular to the input and output shafts, the mounting surface holding the motor and motor-connected auxiliary components.

6. The marine vessel waterjet propulsion apparatus of claim 1 wherein the single support structure includes:

a transmission housing; and mounting brackets secured to the transmission housing and attached to the vessel by the flexible mounts.

7. The marine vessel waterjet propulsion apparatus of claim 1 wherein the single support structure holds the motor in a position substantially over the waterjet.

8. The marine vessel waterjet propulsion apparatus of claim 1 wherein the flexible mounts are mounted on vessel stringers.

* * * * *